United States Patent [19]

Rademakers

[11] Patent Number: 4,466,281

[45] Date of Patent: Aug. 21, 1984

[54] BUOY FOR MEASURING WAVE SLOPES

[75] Inventor: Petrus J. Rademakers, Aerdenhout, Netherlands

[73] Assignee: Datawell B.V., Haarlem, Netherlands

[21] Appl. No.: 338,626

[22] Filed: Jan. 11, 1982

[30] Foreign Application Priority Data

Jan. 15, 1981 [NL] Netherlands ..... 8100164

[51] Int. Cl.[3] ..... B63B 21/52; G01F 23/06

[52] U.S. Cl. ..... 73/170 A; 441/1

[58] Field of Search ..... 441/1, 2, 6, 21, 23, 441/28; 73/170 A

[56] References Cited

U.S. PATENT DOCUMENTS

| | | | |
|---|---|---|---|
| 2,839,920 | 6/1958 | MacAnespie | 73/170 A |
| 3,360,811 | 1/1968 | Bartlebaugh | 441/6 |
| 3,800,601 | 4/1974 | Soulant | 73/17 A |
| 3,893,201 | 7/1975 | Mallory | 441/1 |

FOREIGN PATENT DOCUMENTS

| | | | |
|---|---|---|---|
| 268364 | 11/1911 | Fed. Rep. of Germany . | |
| 2003854 | 1/1970 | Fed. Rep. of Germany . | |
| 2042556 | 5/1971 | Fed. Rep. of Germany | 441/1 |
| 2168374 | 8/1973 | France . | |

*Primary Examiner*—Donald O. Woodiel

*Attorney, Agent, or Firm*—Larson and Taylor

[57] ABSTRACT

Buoy for measuring wave slopes provided with a mainly circular disc shaped body having a mainly horizontal lower surface and protruding downwardly from said lower surface a central circular protrusion having a smaller diameter than said lower surface and dimensioned such that with a horizontal current the pressure deviation caused by said protrusion generates on said lower surface a tilting moment opposite and at least equal to the tilting moment caused by the protrusion itself.

16 Claims, 3 Drawing Figures

BUOY FOR MEASURING WAVE SLOPES

The invention relates to a buoy for measuring wave slopes, provided with a mainly disc shaped float body having a circular or nearly circular plane shape, said float body having a mainly plane bottom surface. With respect to the term "nearly circular" it is remarked that in view of the behaviour of the buoy in streaming water, for instance upon the introduction of turbulences in the boundary layer it may be advantageous to introduce small deviations from the circular shape, for instance, using a polygonal disc or applying vertical ribs, so called trip threads, at the outer wall.

U.S. Pat. No. 3,800,601 to Soulant shows a buoy adapted to measure wave slopes. In this patent no attention is paid to disturbances that may occur due to horizontal water movements which in combination with anchoring forces generate velocity differences between the buoy and the water surrounding it. This known buoy is provided with a cylindrical skirt member at a distance from a lower surface of a disc shaped float body.

Further, the U.S. Pat. No. 3,360,811 shows a waterway marker having a square float body, a ballasting weight of cylindrical shape at its underside and below this ballasting weight an attachment eye for an anchoring line. This waterway marker is due to the latter features unsuitable for following wave slopes.

The French Pat. No. 2.168.374 to Robertshaw Controls Company shows a float body having a concave lower surface and centrally located a semi-spherical protrusion. This float body is intended for measuring oxygen without any necessity to consider measures to let the float body follow wave slopes.

With a buoy as described above one cannot only measure vertical displacements but also the slope and the direction thereof of the water surface. By means of correlation calculations it is then possible to determine the wave direction from the measured data.

A first condition to be fulfilled by such a buoy is that it is relatively insensitive to disturbing momentums such as those introduced by an anchoring line or wind forces which means that the buoy has to have a high rigidity against tilting.

Herein rigidity is defined as the rotational momentum per radial angular displacement for a free swimming buoy.

For this reason the buoy has preferably a large diameter and consequently, in order to limit the total weight, a small draught.

The rigidity of a cylindrical disc with a vertical outer surface is proportional to $R^4$ if R is the radius of the section with the water surface. By chosing R large it consequently is possible to let the buoy follow the wave slope very precisely.

The value of R is, however, limited because the dimensions of the buoy have to stay small in comparison with the wave length, because if the diameter of the buoy becomes of the same order as the wave, the vertical movements and the slopes of the buoy will differ from the vertical movements and the slopes at the location of the centre of the buoy in the absence of the buoy.

A practical compromise is a diameter of 2 to 2.5 m. With a total weight of 400–600 kg this leads to a draught of 10–15 cm.

Apart from the above mentioned disturbing momentums it has been shown that also differences in slope between the buoy and the water surface can be generated by velocity differences between the buoy and the water.

When a cylindrical buoy having its axis vertical is towed over the water with a velocity v, the buoy will, dependent on the velocity, tilt such that it dives at the side as the current arrives and rises at the side as the current leaves.

The angular deviation due to this phenomenon will be called the "dive angle". This dive angle was measured with a model having a diameter D=0.2 m. This angle was measured as a function of the Froude number $=v/\sqrt{gD}$, in which v=velocity in m/sec.

g=gravity accelleration in m/sec$^2$

D=diamter in m.

The measuring results were:

| Fr | Dive angle (degrees) |
|---|---|
| 0.14 | 0.3 |
| 0.29 | 2.5 |
| 0.36 | 5.7 |
| 0.43 | 7.5. |

This phenomenon generates for instance with a constant horizontal velocity a constant angular deviation. This is in itself no hindrance to determine wave height and direction because when handling the measuring data it is easy to "filter out" the constant term.

In case of a wave movement, however, a variation of the horizontal water velocity will occur that has the same frequency as has the wave movement. Then a velocity difference between the buoy and the surrounding water will occur having the wave frequency, because due to always present anchor rigidity, the buoy cannot completely follow the water movement. The anchor rigidity is defined as the horizontal force exerted on the buoy per meter of displacement of the buoy with respect to the anchoring point.

The angular deviations created by this variable velocity difference cannot be filtered out. If moreover, as often happens, the direction of the horizontal variation of the water movement is not the same as the direction of the continuous water movement (for instance the direction of the waves in comparison with a current direction) deviations in the slope to which the buoy is subjected with the frequency of the wave movement will give faulty results when determining the direction of the waves. Herewith it is important to remark that the relatively high frequency portion of the wave spectrum of a free water surface includes wave slopes of not more than 15°, whereas in the lower frequency portion, consequently for the long waves, only very much smaller slopes occur. A wave height of 5 m and a wave period of 20 seconds for instance give only a maximum wave slope of 1.5°.

Comparison of these wave slopes with the measured angular deviations as function of velocity differences shows, that already with small modulations of the relative velocity a serious disturbance of the slope measuring results occurs.

The invention aims to compensate the dive angle of the buoy occurring as consequence of the velocity difference between the buoy and the water surrounding it.

Accordingly the invention provides that in the centre of said bottom surface and adjoining this surface a downwardly projecting protrusion is present causing in case of horizontal movement of the water with respect to the buoy a pressure difference on said bottom surface outside said protrusion that gives a tilting momentum that overrides the tilting momentum exerted by the relative water movement on the said protrusion.

This protrusion in itself causes, due to the pressure increase at the current impact side and a pressure decrease at the downstream side, a momentum that works in the direction of the dive angle. That nevertheless and rather surprisingly an effect occurs that diminishes or even compensates the dive angle is due to the fact that the same pressure increase or decrease that is created by the protrusion and works on it also works on the bottom surface of the disc.

Consequently two mutual opposite momentums are generated, one working on the protrusion itself and increasing the dive angle and one working on the bottom surface of the disc.

With very small depth of the protrusion the vertical surface area of the protrusion is small too, so that both momentums are small, but that working on the protrusion is the smallest. With increasing depth of the protrusion both momentums increase and the compensation of the dive angle increases too. Because, however, the work arm of the momentum working on the protrusion becomes greater and greater and the surface of the protrusion on which the pressure deviations work increases too with increasing depth of the protrusion, a maximum of the compensation will occur, followed by a decrease and finally with a very great depth of the protrusion the effect will be negative. It is, however, well within the reach of the expert to dimension the protrusion such that a desired compensation is obtained.

Experiments have shown that for a disc having a diameter of 2 m, that for values of the Froude member from 0 to 0.5 a compensation is possible that for practical purposes is amply sufficient.

Because the direction of current impact is not known beforehand and the disc mainly is rotationally symmetric the protrusion itself preferably is also rotationally symmetric.

In view of generated current patterns, for instance introducing turbulences in the boundary layer, it may be advantageous to shape the sidewall of the protrusion polygonal to provide it with upwardly running ribs (for instance so called trip threads).

It is however also possible to provide that the protrusion is a truncated cone with the smaller diameter at the lower side or that the protrusion has the shape of part of a sphere.

An effect of the same type as obtained with the invention is also obtainable by shaping the outer wall of the disc such that it slopes with a smaller diameter of the disc at the lower side.

This has however considerable disadvantages because a complete compensation of the dive angle necessitates an angle of a descriptive line of the truncated cone surface with the horizontal of 30°–40°.

Because the disc may not be flooded by water the disc should have a predetermined height above a quiet water surface which for a free floating buoy means that it has to emerge at least 30 cm out of the water. First of all the buoy has to emerge out of the water over a height that equals the so called velocity height $h=v^2/2g$ which at 2 m/sec is about 20 cm. Secondly a certain margin has to be present.

By reason of this the diameter of the buoy at the water line is considerably less than its largest diameter at its upper side. This means that for the same diameter at the upper side or the same maximum diameter the rigidity is decreased in a considerable way. With a buoy having a largest radius of 1 m and an angle of the outer skirt with the horizontal of 30° the radius at the water line is $1-0.3/\text{tg } 30°=0.52$ m.

Because the rigidity is proportional to $R^4$ it will be only 0.073 of the rigidity of a buoy having the same maximum diameter but a vertical outer skirt.

Good results are possible by combining the protrusion according the invention with a slope of the outer wall of the disc, in which case the protrusion allows for a relatively large angle between the outer wall and the horizontal.

A buoy with an outer wall that includes an angle of 60° with the horizontal, a diameter of 2 m, a cylindrical protrusion with a depth of 30 cm and a diameter of 68 cm gave with towing experiments with values of the member of Froude up till 0.5 (corresponding with $v=2$ m/sec) dive angles of less than 0.5°, which angle very rapidly nears zero at decreasing velocity. Comparison with the table above shows that the invention decreases the dive angles caused by the towing effects in a considerable way.

A further advantage of the invention is, that the protrusion gives a good heat exchange with the water. This is of great importance because rather generally used detectors, for instance heave-pitch-roll-sensors Hippy-40 or Hippy-120 contain a stabilization system using a glycerine-water mixture that separates wholly or partly by freezing-out at temperatures below 5° C., making the whole system useless. By good thermal contact with sea-water, which is possible by locating such a sensor in the protrusion according to the invention, it remains possible to use such sensors in regions with very low air temperatures.

Apart from the fundamental improvement, namely a great rigidity with small total dimensions (in comparison with only a sloping outer wall) the invention has further the advantage that the protrusion gives a solution for the extreme dimensional proportions resulting from different conditions, as will be explained below.

The total weight of instruments and batteries is relatively small, so that also the draught of the buoy is relatively small. A practical value with a diameter of about 2 m is a draught of 10–15 cm (corresponding to a total weight of 314–470 kg).

For correctly following the wave slope it is necessary that the centre of gravity of the buoy and its load is the same as the centre of gravity of the displaced water. This means that in a buoy without protrusion the instruments and for instance their energizing means have to be located in a very low room (10 to 15 cm).

If one does not succeed to do so this can entail the condition of ballast of high density near the bottom of the room which is impractical and undesired.

The protrusion increases the depth of the central part so that a room is created without extreme dimensional proportions.

In the example mentioned above with a protrusion of 30 cm the room to be used has a height of 45 cm which is three times the mentioned value of 15 cm. By reason of this it is possible to place the complete load of instruments and batteries in the central cylinder having a diameter of 68 cm and a height of 40–45 cm. In this way a buoy is obtained consisting of a central cylinder with a collar around it, which only has to deliver buoyancy and rigidity. This collar can be filled with or be node of a material having a small density, for instance plastic foam with closed cells.

The advantages hereof are:

The collar cannot sink, for instance after a collision.

The collar functions as a buffer zone during collisions with ships.

The buoy can be transported in demounted condition, for instance a cylinder and four collar segments without the need for mutual electrical connections with water tight plugs.

For calibration and service shipping of the cylinder suffices.

A final advantage of the protrusion is that the centre of gravity Z of the displaced water and that of the buoy and its load can coincide in the centre of the lower surface of the disc. Because the point of application of the anchoring line force preferably is this centre of gravity a construction is possible with which the connection points of an anchoring system are located in the lower surface of the disc, which is very simple.

Without the protruding cylinder the centre of gravity would have been located at about half the draught and the connection points would have been located either at the outer side of the buoy or with a single connection point in a central intrusion up to the level of half the draught. In the first case a big and vulnerable construction is created, whereas in the second case the already uneasily low instruments room would have been disrupted by the central intrusion.

Lowering the centre of gravity and the point of application of anchoring forces has the further advantage that both points are situated at a higher level when the disc capsizes and floats upside down.

In practice it has been shown that such disc shaped buoys in rough sea do times capsize. In this situation the position of the buoy should not be stabile and it should preferably reverse back again. For this reason at the upper side (in the normal position of the buoy) a cylindrical auxiliary float can be mounted. The symmetry axis of this cylinder is vertical. This auxiliary float has in a capsized situation to lift the centre of gravity of the buoy so far above the water level, that the buoy automatically reverses back again. The higher the centre of gravity is located in this situation the smaller may be the auxiliary float. On this auxiliary float which in the normal position of the buoy protrudes above the water, wind forces will work and consequently exert a tilting momentum.

It is now possible by applying the same inventive principle as with the submerged protrusion to reduce the momentum exerted by the wind on the auxiliary float and possibly the tilting momentum exerted by the wind on the total buoy or even to compensate it by providing according to a further elaboration of the invention that on the upper surface of the buoy a centrally located axial symmetric auxiliary float is mounted, which at its plane of engagement with the disc has a diameter that is smaller than that of the disc.

By making the diameter of the auxiliary float smaller than that of the upper side of the buoy again opposite momentums are created, just as with the submerged protrusion. By correct dimensioning again the result can be obtained that the total momentum is equal but opposite to the momentum exerted by the wind forces on the other parts of the buoy that are subjected to wind forces, among others the antenne and the standing wall of the disc above the water.

The influence of a protrusion of predetermined diameter increases with its depth, because with increasing depth the pressure regions working at the lower side of the disc become greater. If however the dimensions of the pressure regions become comparable with those of the buoy with further increase of the depth the momentum working on the protrusion will increase more than the momentum working on the lower surface of the disc. Because both momentums are opposite to each other and for a small depth of the protrusion the momentum working on the disc prevails, the compensation momentum will, starting from a depth zero with increasing protrusion depth firstly grow and via a maximum again decrease to zero and even become negative. For a predetermined compensation effect one has with a predetermined disc and predetermined diameter of the protrusion two protrusion depths giving the desired compensation.

By reason of this ample adaption possibility the diameter and the depth of the protrusion are, when skilfully handled, variable within broad limits. It is only of importance, that the protrusion has a sufficient diameter to create over a sufficient area of the lower disc surface an over-pressure and a sub-pressure, so that the diameter of the protrusion cannot be extremely small ($<0.2\times 2R$) because then the area of the stow pressure and of the subpressure is too small and also cannot be near to the diameter of the disc ($>0.8\times 2R$) because then the surface on which the stow pressure and the sub-pressure may act is too small.

By virtue of the above indicated circumstances it is however possible to fulfill practical dimensioning conditions of the instruments room within wide limits.

In the following the invention is described in light of the drawings in which

Figure 1:
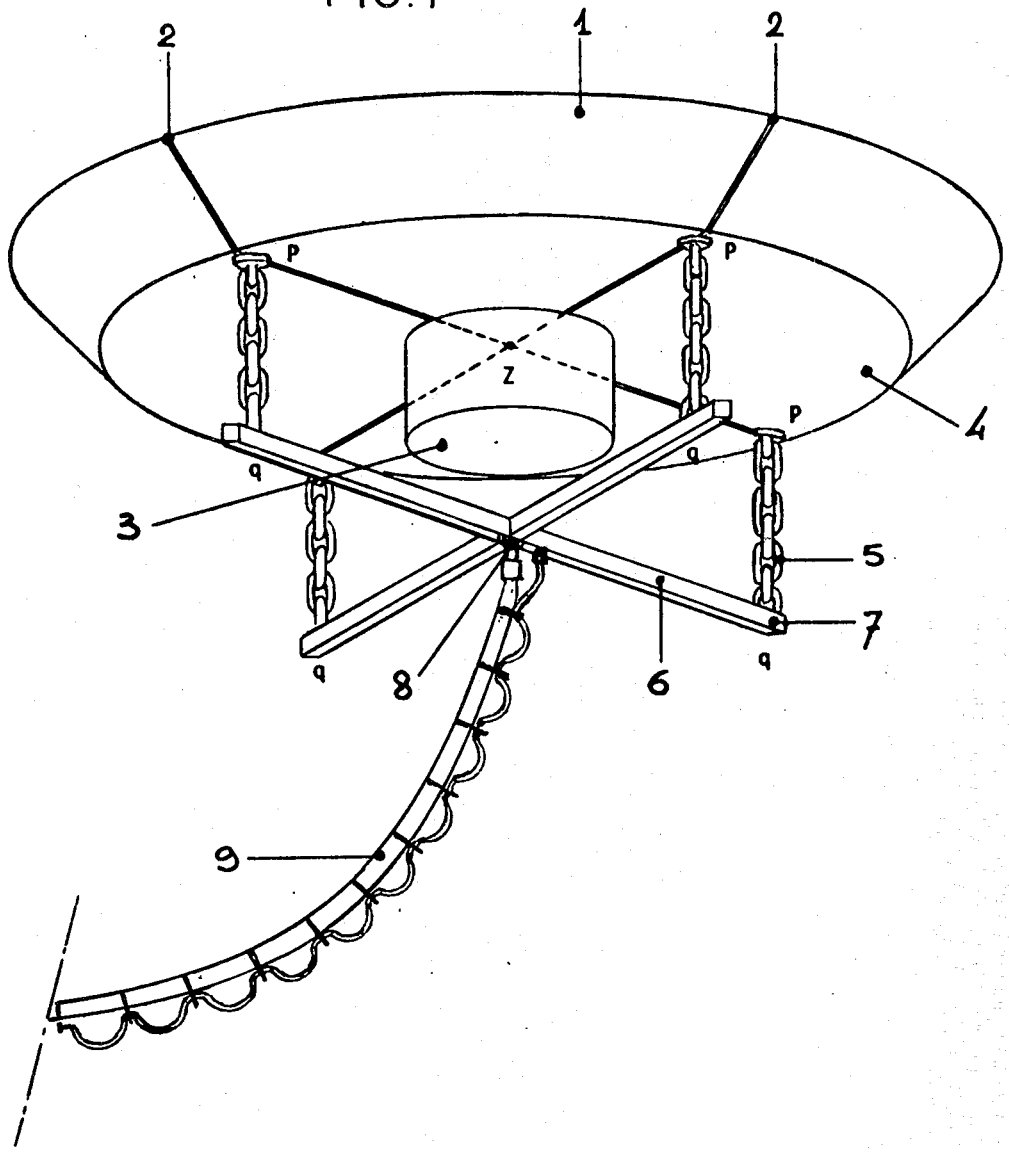
FIG. 1 shows schematically a perspective view of a buoy according to the invention.

In FIG. 1 reference 1 indicates a disc having a plane upper surface, a truncated inwardly directed outer wall and a plane lower surface. The disc consists of four segments which along joining lines 2 are connected to each other, which segments all in their centre have a cylinder-segmental intrusion, in which a cylinder 3 is located. This cilinder can be continued up to the upper surface of disc 1. The centre of gravity of the disc and the cylinder with its contents is located at point Z, that is to say in the lower surface 4 of disc 1. In the same point Z the centre of gravity of the water displaced by the duoy is located. To the lower surface 4 four chains 5 have been connected at points p which are located at the same distance from central point Z of the lower surface of the disc 1 and have mutual equal distances.

The chains 5 are of equal length and at their lower ends a cross 6 has been mounted, the connection points q (one of which is indicated with reference 7) forming the corners of a square which is congruent to the square of points p. In the centre of cross 6 at 8 an anchoring line 9 is attached.

With this construction it is attained that the point of application of the forces exerted by the anchoring line coincides with the point Z.

The sectors from which the disc 1 is made can consist of plastic foam with a cellular structure.

The cylinder 3 forms an independent instrumentation housing that at its upper side can carry a antenne (not shown).

Figure 2:
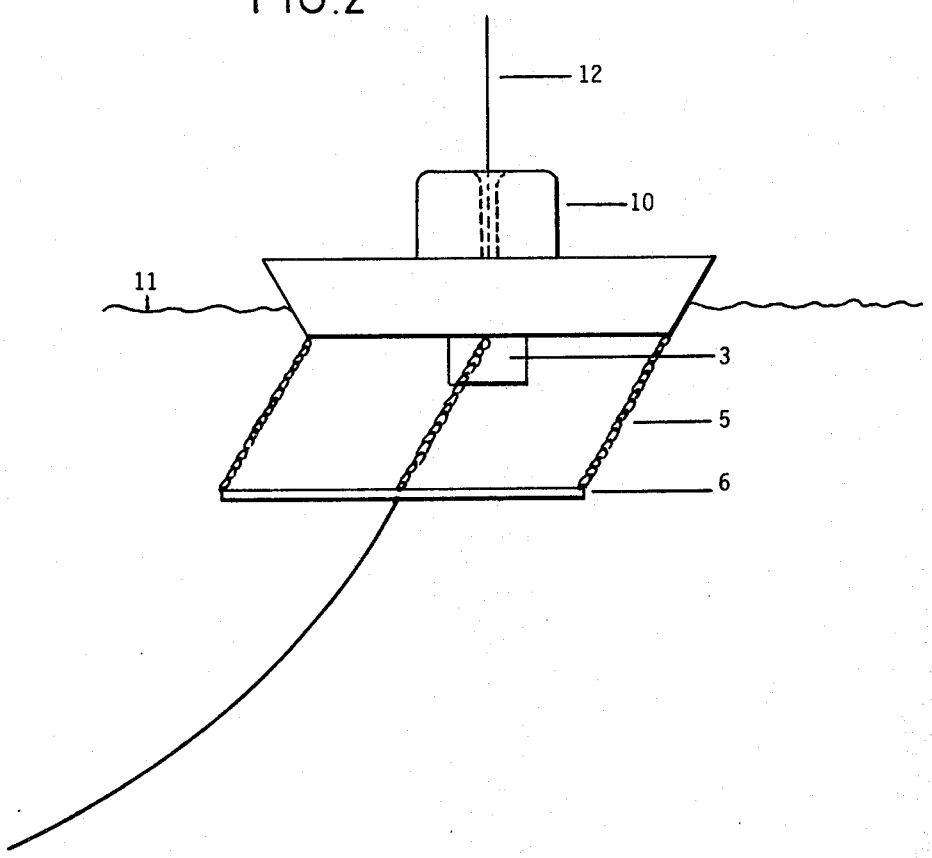
FIG. 2 shows a side view of a further embodiment.

FIG. 2 shows a side view of an embodiment having an auxiliary float 10 and an antenne 12, the water line being indicated at 11.

Figure 2A:
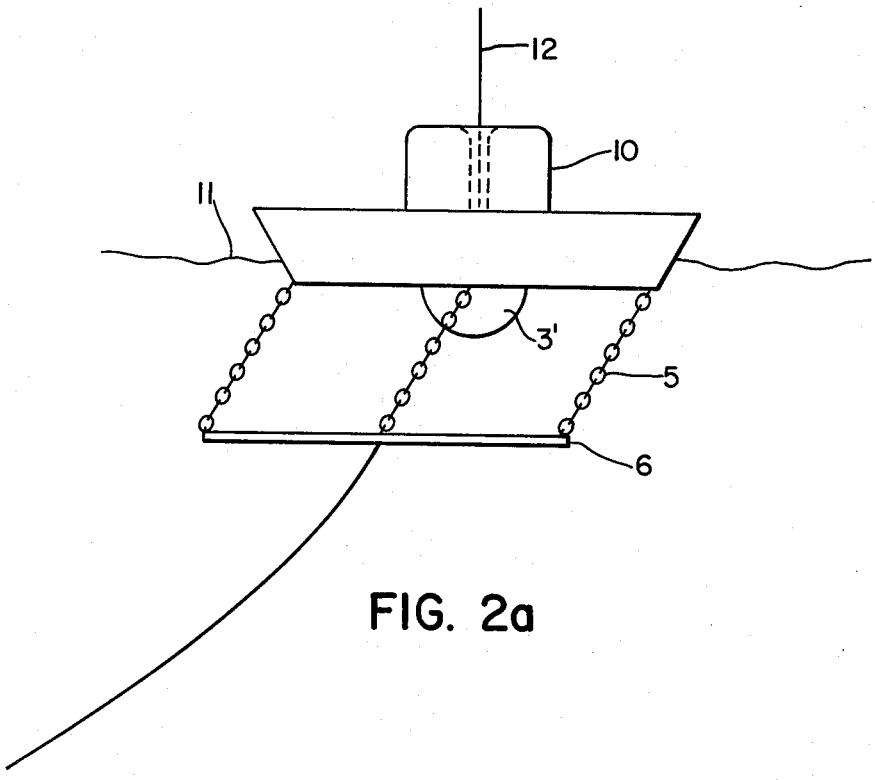
FIG. 2*a* shows a side view of a further embodiment.

Finally, FIG. 2*a* shows a further embodiment, in which the downward protrusion 3' is semi-spherical.

What I claim is:

1. Buoy adapted to follow wave slopes for measuring these slopes, provided with a circular or nearly circular mainly disc shaped float body having a horizontal dimension that is greater than its height, said float body being provided with a horizontal bottom surface provided with an axially symmetric central downward protrusion which, in case of horizontal movement of the water with respect to the buoy, causes a pressure distribution on said bottom surface which causes a tilting momentum that counteracts and overrides the tilting momentum exerted by the said water movement on the protrusion, said buoy being provided with mutual parallel connection links pivotable in all directions attached at their upper ends to said bottom surface in locations that are located at a greater distance from the said protrusion than half the height of said protrusion and at their lower ends to an anchoring line connection member which is provided with means for attaching an anchoring line, the diameter of the protrusion at the level of the said bottom surface being between 0.2 and 0.8 times the diameter of said bottom surface.

2. Buoy according to claim 1, wherein the disc is solid, and of a material which has a density which is less than 1 gram per cubic centimeter, and wherein the protrusion is a closed vessel having measuring means located therein and an antenna protruding upwardly from the vessel through the disc.

3. Buoy according to claim 1, wherein the disc comprises a number of solid parts connected to each other.

4. Buoy according to claim 1, wherein the upper surface of the disc includes an auxiliary float body which is concentric with the disc, the surface area of contact between the auxiliary float body and the first said float body having a diameter which is less than that of the upper surface of the disc.

5. Buoy adapted to follow wave slopes provided with a closed central axially symmetric vessel provided with instrument means for measuring said wave slopes, said central vessel being surrounded by an axially symmetric or almost axially symmetric disc shaped float body having a horizontal bottom surface with a diameter that is greater than the height of the float body, said closed vessel protruding downwardly from said float body, the part of the vessel protruding downward from the float body comprising means for causing, in case of horizontal movements of the water with respect to the buoy, a pressure distribution on said bottom surface outside said protruding part, which creates a tilting momentum that opposes and overrides the tilting momentum exerted by said water movement on said protruding part, said protruding part having at the level where it emerges from the float a diameter between 0.2 and 0.8 times the diameter of the said bottom surface.

6. Buoy according to claim 5 in which said float body contains a number of circle sector shaped solid parts of a material having a density that is less that 1 gram per cubic centimeter, said buoy being provided with anchorng links connected to an anchorng line connection member provided with means for attaching an anchoring line.

7. Buoy according to claim 5, wherein the disc is solid, and of a material which has a density which is less than 1 gram per cubic centimeter, and wherein the protrusion is a closed vessel having measuring means located therein and an antenna protruding upwardly from the vessel through the disc.

8. Buoy according to claim 5, wherein the disc comprises a number of solid parts connected to each other.

9. Buoy according to claim 5, wherein the upper surface of the disc includes an auxiliary float body which is concentric with the disc, the surface area of contact between the auxiliary float body and the first said float body having a diameter which is less than that of the upper surface of the disc.

10. Buoy according to claim 5, wherein the buoy is provided with a plurality of connection links leading from points of the buoy located laterally outside of its centre and above its lowest part, toward an anchoring line connection member, which member is provided with means for attaching an anchoring line.

11. Buoy according to claim 5, in which the protrusion is cylindrical.

12. Buoy according to claim 5, in which the protrusion has the shape of part of a sphere.

13. Buoy according to claim 5, in which the outer wall of the disc at the level of the water line is vertical.

14. Buoy according to claim 5, in which the outer wall of the disc at the level of the water line slopes such that in the upward direction the diameter of the disc increases.

15. Buoy for measuring wave slopes, provided with a horizontal axially symmetric disc shaped float body having a greater diameter than height and a horizontal bottom surface, said float body surrounding a closed vessel containing instruments for measuring wave slopes and having an axially symmetric part protruding downward from said float body, said protruding part and said bottom surface being dimensioned such that a horizonal water movement with respect to the buoy exerts such forces on the said bottom surface and the said bottom surface counteracts and overrides the momentum exerted on the protruding part, mutual parallel anchoring links being at one end attached to said bottom surface at locations further away from said protruding part than half the height of said protruding part, the other ends of the anchoring links being connected to an anchoring line connection member provided with means for attaching an anchoring line, said closed vessel containing instrument means for measuring wave slopes, and said disc shaped float body having an outer surface which at the level of the waterline, slopes such that in the diameter of the disc increases in the upward direction.

16. Buoy according to claim 15 in which an auxiliary float body is mounted to the upper side of the disc shaped float body, said disc shaped float body having a plain upper surface surrounding said auxiliary float body, which is mainly axially symmetric and coaxial to the disc shaped float body.

* * * * *